US005730538A

United States Patent [19]

Kato

[11] Patent Number: 5,730,538

[45] Date of Patent: Mar. 24, 1998

[54] INK JET PRINTER

[75] Inventor: Hiroyuki Kato, Nagoya, Japan

[73] Assignee: Brother Kogyo Kabushiki Kaisha, Nagoya, Japan

[21] Appl. No.: 742,903

[22] Filed: Nov. 1, 1996

[30] Foreign Application Priority Data

Nov. 16, 1995 [JP] Japan ..... 7-323895

[51] Int. Cl.[6] ..... B41F 35/00

[52] U.S. Cl. ..... 400/702.1; 347/33; 347/31

[58] Field of Search ..... 400/701, 702, 400/702.1, 139, 185, 187; 347/33, 32, 30, 31

[56] References Cited

U.S. PATENT DOCUMENTS

| | | | |
|---|---|---|---|
| 5,394,178 | 2/1995 | Grange . | |
| 5,534,896 | 7/1996 | Osborne | 347/29 |
| 5,587,729 | 12/1996 | Lee et al. | 347/32 |
| 5,612,721 | 3/1997 | Ishize | 347/33 |
| 5,644,345 | 7/1997 | Toniolo | 347/32 |
| 5,663,751 | 9/1997 | Holbrook | 347/22 |

FOREIGN PATENT DOCUMENTS

| | | |
|---|---|---|
| 0 398 348 A | 11/1990 | European Pat. Off. . |
| 0 494 693 A | 7/1992 | European Pat. Off. . |
| 40 00 414 A | 7/1991 | Germany . |
| A-3-182360 | 8/1991 | Japan . |
| A-3-246052 | 11/1991 | Japan . |
| A-5-42675 | 2/1993 | Japan . |

*Primary Examiner*—Edgar S. Burr
*Assistant Examiner*—Dave A. Ghatt
*Attorney, Agent, or Firm*—Oliff & Berridge, PLC

[57] ABSTRACT

An ink jet printer capable of easily controlling a wiping unit, or cleaning unit, by use of driven members that pivot when they come into contact with a carriage. The ink jet printer is provided with first and second driven members that are disposed in association with a travel path of the carriage. The driven members selectively project into the travel path of the carriage. As a result of the carriage coming into contact with the first driven member, a wiper member moves to a projected position. As a result of the carriage's further movement toward the second driven member, the wiper member wipes a nozzle surface of a print head. Further, as a result of the carriage moving toward the second driven member, the wiper member wipes the nozzle surface of the print head. As a result of the carriage coming into contact with the second driven member, the wiper member moves to a standby position.

18 Claims, 5 Drawing Sheets

INK JET PRINTER

BACKGROUND OF THE INVENTION

1. Field of the Invention

The invention relates to an ink jet printer.

2. Description of Related Art

In general, an ink jet printer records information on a recording medium, such as record paper, by ejecting an ink droplet. A main body case houses therein an ink jet print head, ink cartridges that contain ink to be supplied to the print head, a recording unit on which the ink jet print head and the ink cartridges are removably mounted, a transport unit which has transport rollers to transport record paper, or another recording medium, and a carriage unit which moves a carriage mounted with the recording unit according to the size .of the recording medium transported by the transport unit.

The ink jet printer of this type is designed so as to record information by ejecting ink droplets. Because of the structure, ink sometimes remains on a discharge surface of the print head after a large amount of data has been printed. In the event of a blockage of the ink or of ejecting failures, the print head is covered with an absorption cap. Then, the defective ink remaining in the print head is sucked by an absorption means, such as a pump, through the absorption cap. As a result of the sucking operation, ink sometimes remains on the ink discharge surface of the print head.

In any event, the recording medium is soiled with the residual ink, or the residual ink dries up and solidifies, which again results in ejection failures. To prevent this problem, it has been commonly practiced to provide the ink jet printer with a wiping unit to wipe the residual ink.

However, actuation timing of the wiping unit is controlled by a cam mechanism in such an ink jet printer, which complicates the structure of the ink jet printer. In contrast, there is a demand for a control system which is as simple as possible.

SUMMARY OF THE INVENTION

The invention has been conceived in view of the above-described drawbacks in the art, and the object of the invention is to provide an ink jet printer capable of easily controlling a wiping unit by the use of driven members which are actuated on the basis of the movement of a carriage.

To this end, according to one aspect of the invention, there is provided an ink jet printer including a print head for ejecting ink droplets from nozzles, and carriage actuation means for moving a carriage having the print head mounted thereon back and forth, the improvement being characterized by comprising a wiper member which is movable between a projected position projected into a travel path of the print head and a standby position backed from the travel path of the print head, and which wipes a nozzle surface of the print head when it is situated in the projected position; first and second driven members which are disposed in association with the travel path of the carriage, and which selectively project into the travel path of the carriage; and control means which performs a control operation in such a way that the wiper member moves to the projected position as a result of the carriage coming into contact with the first driven member, that the wiper member wipes the nozzle surface of the print head as a result of the carriage traveling toward the second driven member, and that the wiper member moves to the standby position as a result of the carriage coming into contact with the second driven member.

In the ink jet printer of the invention having the above-described structure, the wiper member travels to the projected position projected into the travel path of the print head as a result of the carriage coming into contact with the first driven member. The wiper member wipes the nozzle surface of the print head as a result of the travel of the carriage toward the second driven member. The wiper member moves to the standby position away from the travel path of the print head as a result of the carriage coming into contact with the second driven member.

In one preferred embodiment of the invention, the ink jet printer preferably has a link member which connects the first and second driven members with each other and moves the wiper member between the projected position and the standby position. In the ink jet printer of the invention preferably having the above-described link member, the wiper member travels between the projected position and the standby position by means of the link member that connects the first and second driven members with each other.

In one preferred embodiment of the invention, the ink jet printer is preferably provided with an absorption member for sucking the ink remaining in the print head, and maintenance means which is joined to the control means and causes the absorption member to start an absorbing operation when the carriage comes into contact with the first driven member. In the ink jet printer preferably having the absorption member and the maintenance means, the absorption member starts to suck the ink remaining in the print head when the carriage comes into contact with the first driven member.

In one preferred embodiment of the invention, the maintenance means of the ink jet printer preferably has a cam member which pivots so as to cause the absorption member to perform an absorbing operation. In the ink jet printer of the invention having the above-described structure, when the carriage comes into contact with the first driven member, the cam member that causes the absorption member to perform an absorbing operation is joined to a gear of the drive source. In contrast, when the carriage comes into contact with the second driven member, the cam member is disconnected from the gear of the drive source.

In one preferred embodiment of the invention, the control means is preferably provided with a spring member for maintaining the first and second driven members in their states obtained after the carriage has come into contact with the first and second driven members. If the first and second driven members are brought into contact with the carriage, the spring member maintains the first and second driven members in their states obtained after they have been brought into contact with the carriage.

As previously described, according to the invention, if the carriage comes into contact with the first driven member under the control of the control means, the wiper member moves to the projected position projected into the travel path of the print head. As a result of the movement of the carriage toward the second driven member, the wiper member wipes the nozzle surface of the print head. If the carriage comes into contact with the second driven member, the wiper member moves to the standby position away from the travel path of the print head. It becomes possible to control the actuation of the wiper member by use of the driven members without the need for a complicated structure like a cam mechanism.

In one preferred embodiment of the invention, the wiper member is preferably arranged so as to travel between the projected position and the standby position by means of the link member that connects the first and second driven members with each other. The actuation of the wiper member can be simply implemented by use of the link member that connects the driven members with each other.

In one preferred embodiment of the invention, the absorption member is preferably arranged so as to start to suck ink from the print head as a result of the carriage coming into contact with the first driven member. The initiation of absorption of the absorbing member that sucks the ink from the print head can be simply controlled.

In one preferred embodiment of the invention, if the carriage comes into contact with the first driven member, the cam member that causes the absorption member to perform an absorbing operation is preferably joined to the gear of the drive source. In contrast, if the second driven member is brought into contact with the carriage, the cam member is disconnected from the gear of the drive source. Hence, the use of the driven members enables simple control of the cam member that causes the absorption member to perform an absorbing operation.

In one preferred embodiment of the invention, if the carriage comes into contact with the first and second driven members, the spring member preferably maintains the first and second driven members in their states obtained after they have come into contact with the carriage. Therefore, even if the carriage moves away from the driven members, the first and second driven members can be maintained in an operating state by means of the spring member.

BRIEF DESCRIPTION OF THE DRAWINGS

A preferred embodiment of the invention will be described in detail with reference to the following figures, wherein.

DESCRIPTION OF THE PREFERRED EMBODIMENT

With reference to the accompanying drawings, a preferred embodiment of the invention will be described hereinbelow.

Figure 1:
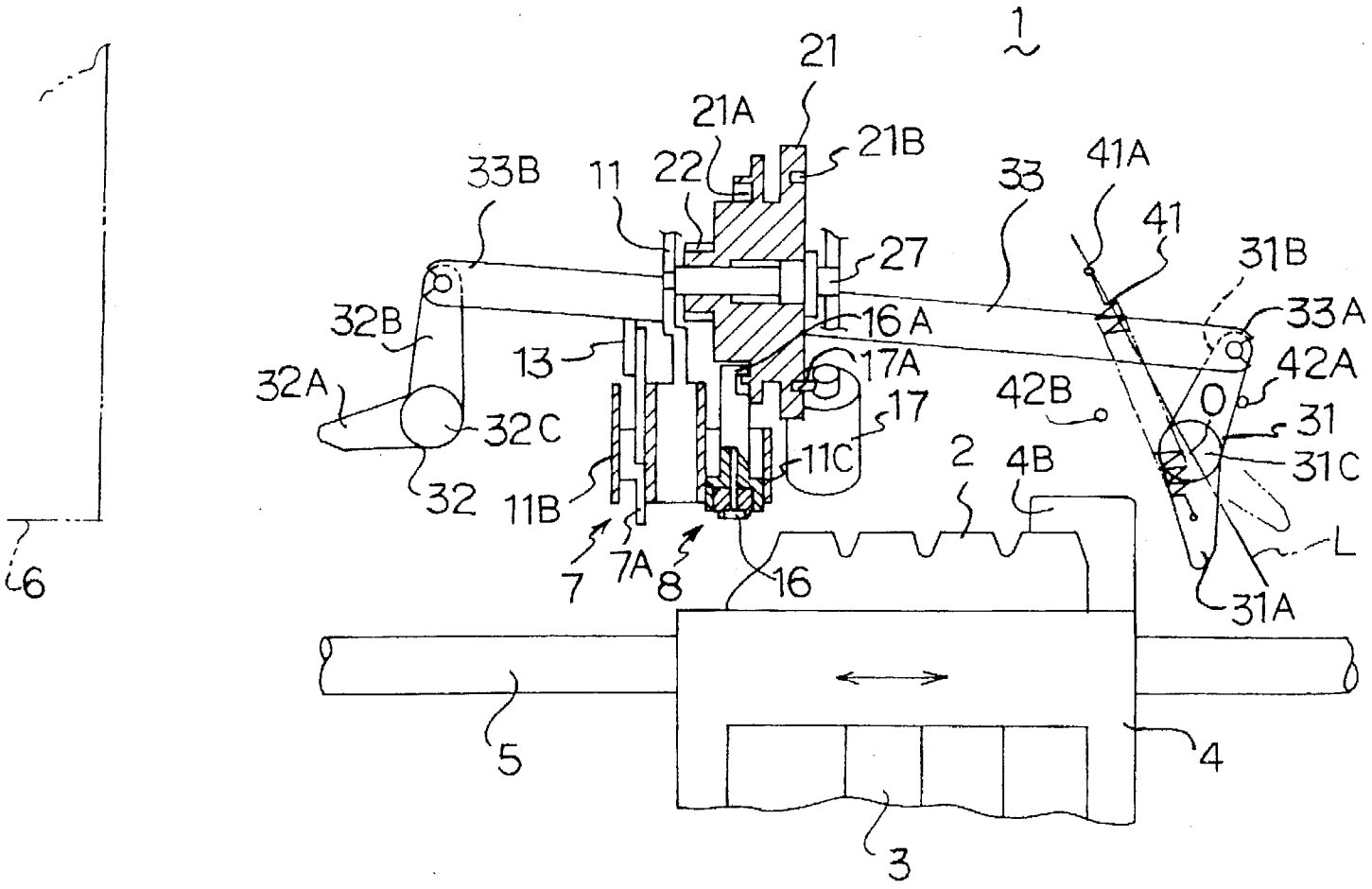
FIG. 1 is a diagrammatic representation of the overall structure of an ink jet printer according to the invention.

FIG. 1 is a diagrammatic representation of the pertinent structure of an ink jet printer 1 according to the invention. As shown in FIG. 1, the ink jet printer 1 includes an ink jet print head 2 for ejecting ink droplets from nozzles, a plurality of ink cartridges 3 (e.g., yellow, magenta, and cyan) which contain ink to be supplied to the print head 2, a carriage 4 having the ink jet print head 2 with the ink cartridges 3 removably mounted on the carriage 4, and a guide rail 5 along which the carriage 4 travels back and forth by means of a carriage actuation mechanism (carriage actuation means). An engagement recess 4A (FIG. 2) is formed in the carriage 4. The engagement recess 4A can engage with a guide 11A of a frame member 11 in a slidable manner.

Transport rollers (not shown) transport print paper 6, which is a recording medium, in the direction orthogonal to the direction of the travel of the carriage 4 by means of a transport mechanism (recording medium transport means).

A wiping unit 7 for wiping the ink remaining on a discharge surface of the print head 2 and a maintenance unit 8 for making the print head 2 recover from a blocked state or ejecting failures are disposed in association with the travel path of the print head 2.

Figure 6:
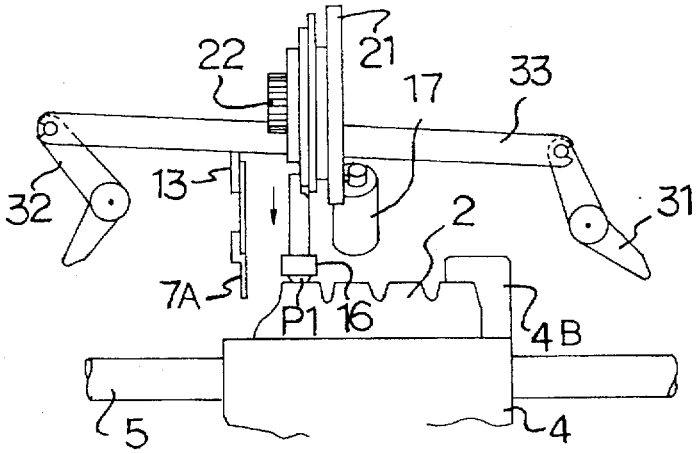
FIG. 6 shows the operation of the ink jet printer according to the invention.
Figure 7:
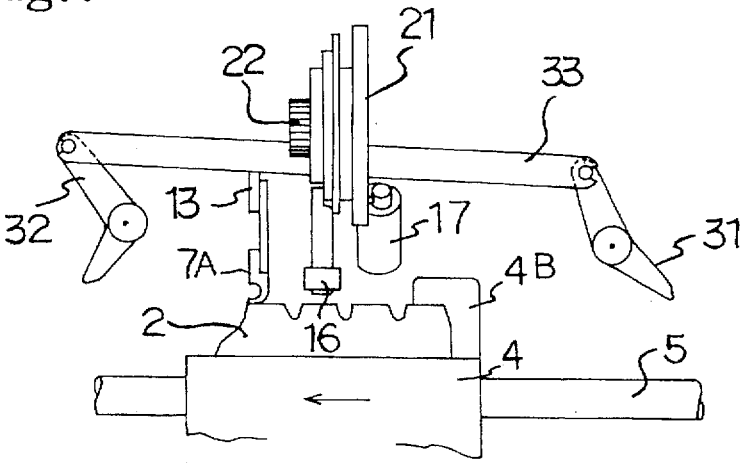
FIG. 7 shows the operation of the ink jet printer according to the invention.

The wiping unit 7 is provided with a wiper member 7A for wiping the nozzle surface of the print head 2. The wiper member 7A travels between a projected position (see FIGS. 5–7) projected into the travel path of the print head 2 and a standby position (see FIGS. 1 and 8) away from the travel path of the print head 2 along a first guide member 11B of the frame 11.

Figure 2:
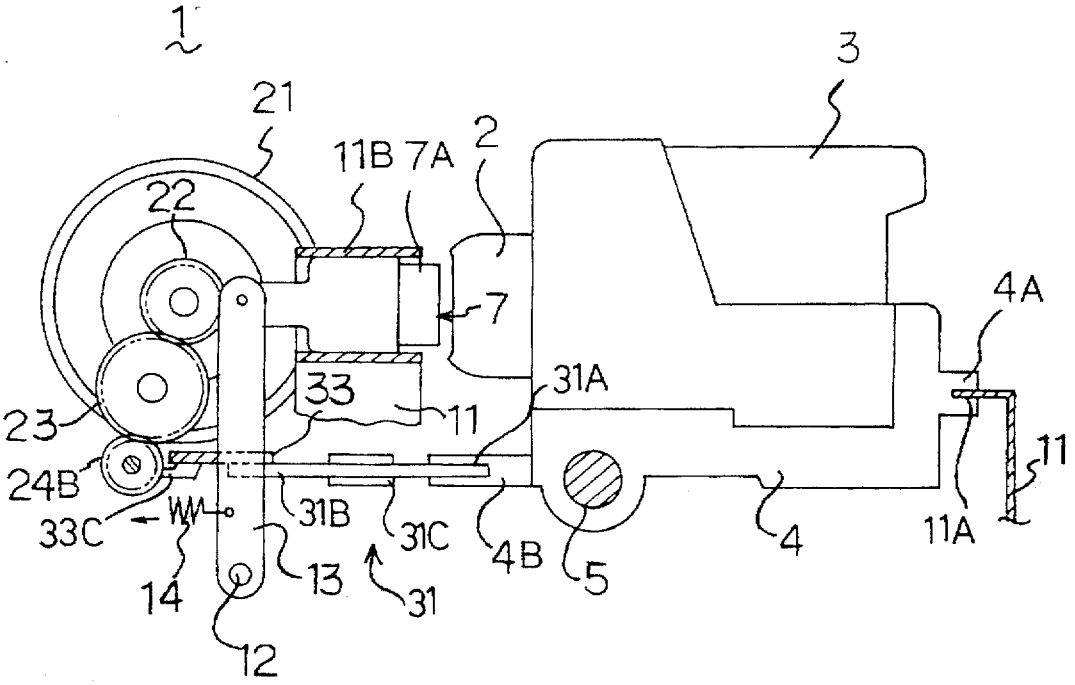
FIG. 2 shows an absorption cap and its surrounding area according to the invention.

As shown in a detailed manner, the wiper member 7A of the wiping unit 7 is connected to the leading end of a lever 13 that has its base supported so as to pivot on a pivot 12 (FIG. 2). The lever 13 is pivoted counterclockwise (direction of arrow in FIG. 2) by means of a spring 14 connected to the vicinity of the base of the lever 13. In short, the lever 13 is constantly forced so as to withdraw the wiper member 7A.

On the other hand, the maintenance unit 8 is provided with a retractable absorption cap (i.e., an absorption member) 16. When the print head 2 moves from a printable area to a maintenance area, the absorption cap 16 covers at least a portion of the print head 2. A negative pressure is generated by a sucking pump 17 so that defective ink within the print head 2 is absorbed. As a result, the print head 2 recovers to a normal condition. The absorption cap 16 is guided by a second guide member 11C of the frame member 11.

The maintenance unit 8 is provided with a cam member 21 having cam grooves 21A and 21B formed in its both sides. The cam member 21 is rotatively supported on the frame member 11 via a rotary shaft 27. An engagement section 16A of the absorption cap 16 and an engagement section 17A of an absorption pump 17 engage with the cam grooves 21A and 21B of the cam member 21, respectively. The absorption cap 16 and the absorption pump 17 are actuated by rotation of the cam member 21, whereby the cam member 21 performs a predetermined operation.

Figure 3:
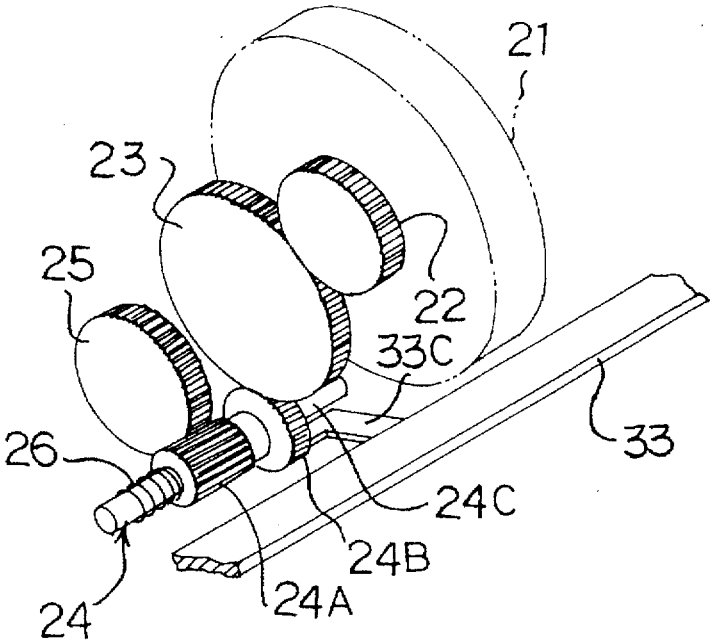
FIG. 3 is a perspective view which shows cams and their surrounding area according to the invention.
Figure 4:
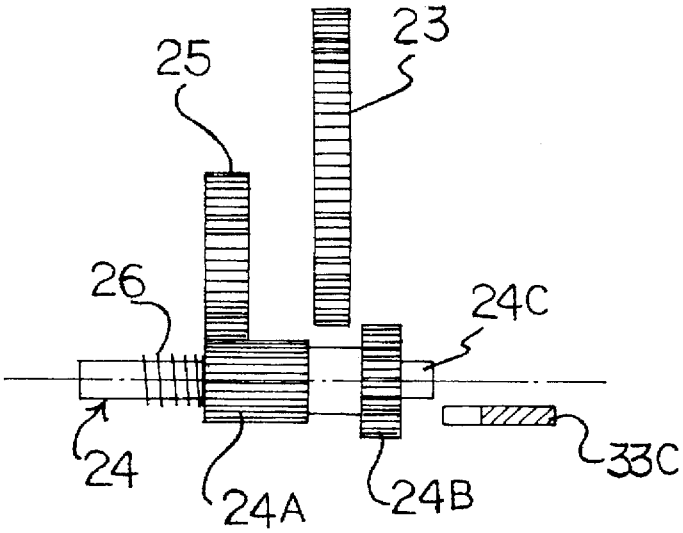
FIG. 4 shows the relationship between gears according to the invention.

A cam gear (i.e., an absorbing operation gear) 22 is formed so as to be integral with the cam member 21, as shown in FIGS. 3 and 4. The cam gear 22 meshes with an idle gear 23. A slide gear 24 capable of sliding in the axial direction is arranged so as to engage with (mesh) and disengage from the idle gear 23. The slide gear 24 comprises a first gear 24A and a second gear 24B which are fitted around a rotary shaft 24C so as to be spaced a predetermined interval apart from each other. The first gear 24A is formed so as to be axially long. As a result, the first gear 24A constantly meshes with a drive gear 25 (e.g., a gear of a drive source such as the recording medium transport means), which is rotated by a drive source (not shown), irrespective of the sliding action of the slide gear 24.

The second gear 24B of the slide gear 24 is constantly biased to disengage from the idle gear 23 by a coil spring 26.

Consequently, the slide gear 24 slides against a spring force of the coil spring 26. If the second gear 24B is meshed with the idle gear 23, torque is transmitted so that the cam member 21 is rotated. In an ordinary state, the second gear 24B of the slide gear 24 is disengaged from the idle gear 23, and therefore the cam member 21 is disconnected from the drive source.

First and second driven members 31, 32 are arranged so as to be actuated in accordance with the movement of the carriage 4 as well as to selectively project into the travel path of the carriage 4. The first and second driven members 31, 32 are disposed so as to be spaced a predetermined interval apart from each other with the wiping unit 7 and the maintenance unit 8 interposed between them. The first and second driven members 31, 32 are substantially L-shaped, as well as being symmetrical about the cam member 21. The first and second driven members 31, 32 comprise respective contact portions 31A, 32A which come into contact with the carriage 4, joints 31B, 32B which are connected with each other via a link member 33, and pivots 31C, 32C interposed between the contacts 31A, 32A and the joints 31B, 32B, respectively. The angle defined between the contact portion 32A and the joint 32B of the second driven member 32 is set so as to be smaller than the angle defined between the contact portion 31A and the joint 31B of the first driven member 31. The second driven member 32 is disposed in a rearward direction with respect to the first driven member 31, that is, it is disposed so as to be spaced apart from the travel path of the carriage 4. The end 33B of the link member 33 connected to the second driven member 32 is disposed in a rearward direction with respect to the other end 33A connected to the first driven member 31, that is, it is disposed so as to be spaced apart from the travel path of the carriage 4. The lever 13 is forced so as to come into contact with the link member 33 by means of the spring 14.

The first and second driven members 31, 32 and the link member 33 constitute control means that performs the following operations.

As a result of the carriage 4 coming into contact with the contact portion 31A of the first driven member 31, the wiper member 7A of the wiping unit 7 projects into the travel path of the print head 2. Further, as a result of the carriage 4 traveling toward the second driven member 32 along the guide rail 5, the wiper member 7A wipes the nozzle surface of the print head 2. As a result of the carriage 4 coming into contact with the second driven member 32, the wiper member 7A recedes. In short, by virtue of the positional relationship between the first and second driven members 31, 32 and their shapes, the link member 33 moves forward (i.e., toward the carriage 4) as well as leftward when the contact portion 31A of the first driven member 31 comes into contact with an engagement protuberance 4B of the carriage 4. In contrast, when the contact portion 32A of the second driven member 32 comes into contact with the engagement protuberance 4B, the link member 33 moves rearward (i.e., in the direction moving away from the carriage 4) as well as rightward. Consequently, the wiper member 7A of the wiping unit 7 travels back and forth.

The link member 33 has a protuberance 33C which is disposed in an upper position with respect to the spring 14 in a rearward direction of the lever member 13 that causes the wiper member 7A to advance to the inside of, or to recede from, the travel path of the print head 2. The protuberance 33C projects in the rearward direction and causes the slide gear 24 to move against the spring force of the coil spring 26 (see FIGS. 2 and 3). When the carriage 4 comes into contact with the first driven member 31, the link member 33 moves. Then, the protuberance 33C presses the first gear 24A of the slide gear 24 in defiance of the spring force of the coil spring 26. Consequently, the second gear 24B meshes with the idle gear 23 in the manner as previously described, so that torque is transmitted to the cam member 21, whereby the cam member 21 rotates. As a result, the absorption cap 16 and the absorption pump 17 of the maintenance unit 8 start an absorbing operation. In contrast, when the carriage 4 comes into contact with the second driven member 32, the first gear portion 24A of the slide gear 24 is disengaged from the idle gear 23 by means of a spring force of the coil spring 26.

A spring 41 is connected to the contact portion 31A of the first driven member 31. When the first driven member 31 or the second driven member 32 is brought into contact with the carriage 4, the spring 41 retains the state of the first or second driven member 31, 32 obtained after it has come into contact with the carriage 4. If the center line of the spring member 41 exceeds a line L, that connects a fixed end 41A of the spring member 41 with a pivot center O of the driven member 31, the first driven member 31 rotates by means of the spring force of the spring member 41. Stoppers 42A and 42B regulate the extent of pivotal movement of the first driven member 31. The first driven member 31 pivots in the range defined between the projected position (designated by a solid line shown in FIG. 1) and the standby position (designated by a chain line shown in FIG. 1) while maintaining contact with one of the stoppers 42A, 42B. In contrast, the second driven member 32 pivots in the range defined between the standby position and the projected position in reverse order to how the first driven member 31 pivots.

With the above-described structure, the carriage 4 travels along the guide rail 5 so as to move from the printable area facing the print paper 6 (in a rightward direction in the embodiment) when a controller (not shown) instructs the maintenance unit to perform maintenance of a specific nozzle of the print head 2. Further, the drive source of the drive gear 25 also starts to rotate.

Figure 5:
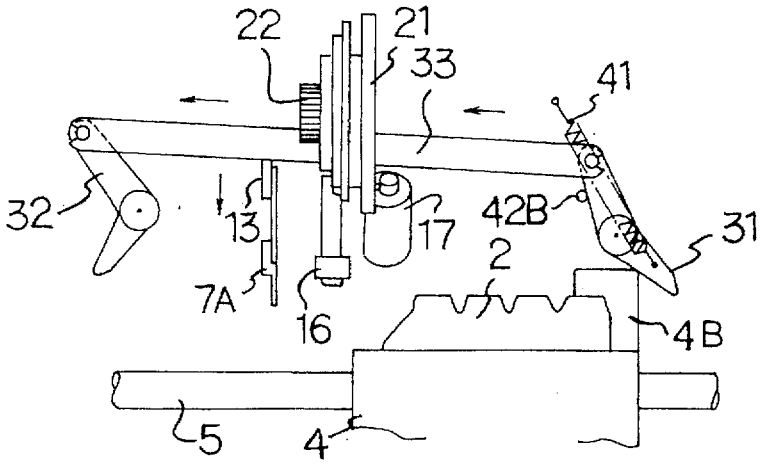
FIG. 5 shows the operation of the ink jet printer according to the invention.

The engagement protuberance 4B of the carriage 4 comes into contact with the contact portion 31A of the first driven member 31 as a result of the movement of the carriage 4. As shown in FIG. 5, the first driven member 31 rotates counterclockwise, moving link member 33 in the direction of the arrows, and comes into contact with the stopper 42B, whereby the first driven member 31 is stopped. The link member 33 moves forward (toward the carriage 4) as well as leftward as the first driven member 31 rotates. In this event, the second driven member 32, joined to the first driven member 31 via the link member 33, also rotates counterclockwise as a result of the pivotal movement of the first driven member 31. Then, the contact portion 32A projects into the travel path of the carriage 4.

As a result of the forward movement of the link member 33, the link member 33 presses against the lever 13, whereby the lever 13 pivots against the spring force of the spring 14. The wiper member 7A moves forward so as to project into the travel path of the print head 2.

In conjunction with the forward movement of the wiper member 7A, the protuberance 33C of the link member 33 presses the first gear 24A of the slide gear 24 counter to the spring force of the coil spring 26. As a result, the slide gear 24 slides so that the second gear 24B meshes with the idle gear 23. As a result of this, torque is transmitted to the cam member 21, and the cam member 21 starts to rotate. Thus, the absorption cap 16 starts to advance toward the print head 2.

When the engagement protuberance 4B of the carriage 4 comes into contact with the contact portion 31A of the first driven member 31 by means of the controller (not shown), the carriage 4 immediately reverses the direction of movement to left. The nozzle that needs maintenance is moved to the position where it faces the absorption cap 16 (see FIG. 6). At this time, the absorption cap 16 hermetically covers the predetermined nozzle at the position where the carriage 4 is stopped. As a result of the further rotation of the cam member 21, the absorption pump 17 is actuated, whereby an absorbing operation is started. Ink is sucked from the predetermined nozzle. Even if the carriage 4 moves away from the first driven member 31, the first driven member 31 is held in the above-described position by the spring member Further, the advanced position of the wiper member 7A and the rotation of the cam member 21 are also maintained.

After the cam member 21 has rotated substantially once, the actuation of the absorption pump 17 is stopped. The absorption cap 16 recedes away from the nozzle. In this condition, the drive source of the drive gear 25 stops its rotation.

Subsequently, the carriage 4 starts to move left toward the printable area, the wiper member 7A already in the advanced position wipes the discharge surface of the nozzle. The ink remaining on the discharge surface is removed after the absorbing operation (see FIG. 7).

Figure 8:
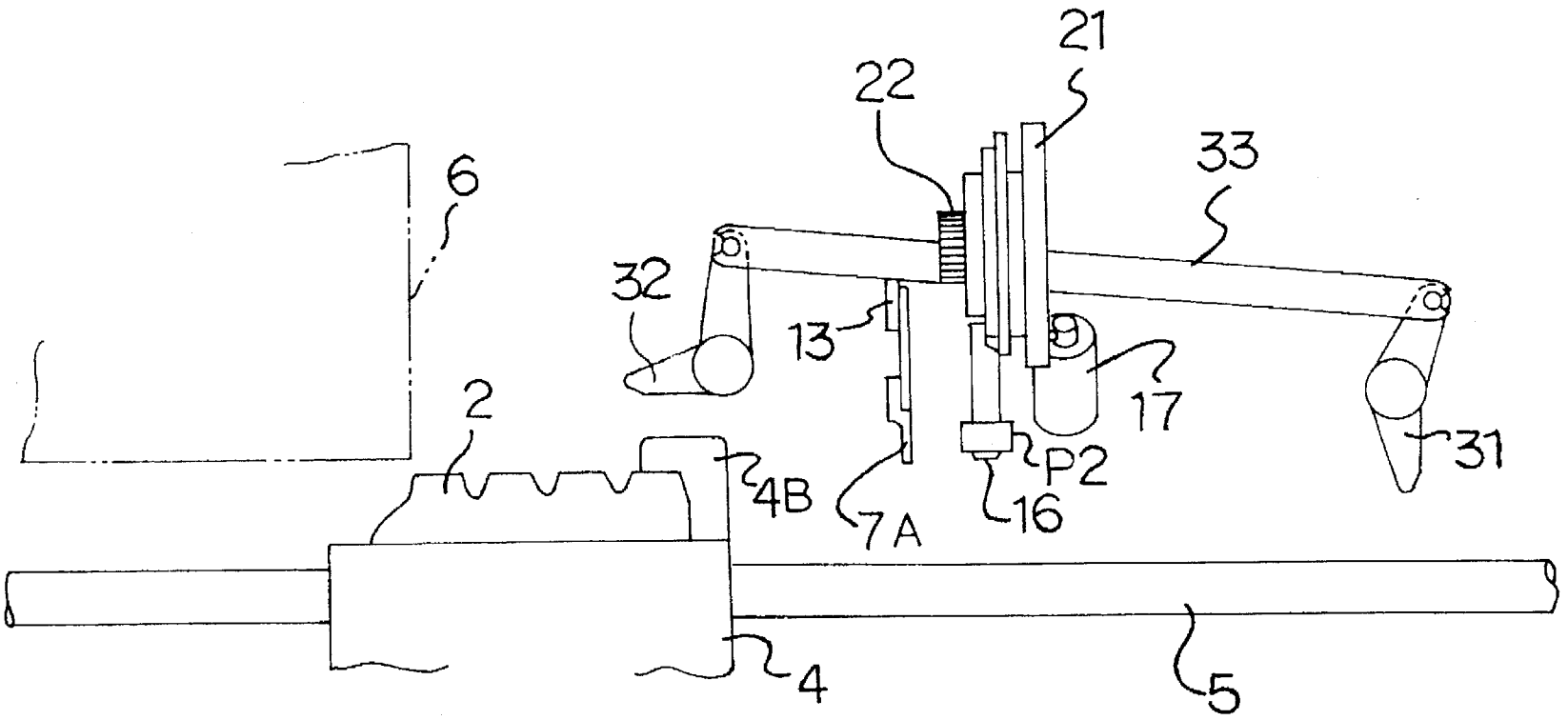
FIG. 8 shows the operation of the ink jet printer according to the invention.

When the carriage 4 further moves left so as to return to the printable area, the engagement protuberance 4B of the carriage 4 comes into contact with the contact portion 32A of the second driven member 32, as shown in FIG. 8, whereby the second driven member 32 rotates clockwise. In conjunction with the rotation of the second driven member 32, the link member 33 moves rearward as well as rightward in reverse order to the previously described order. As a result, the lever 13 and the slide gear 24 are freed from the regulation by the link member 33, so that the lever 13 pivots by means of the spring force of the spring 14 withdrawing the wiper member 7A and disengaging the second gear 24B of the slide gear 24 from the idle gear 23. The second driven member 32 is retained so as not to interfere with the carriage 4, until the carriage 4 moves right from the printable area and comes into contact with the first driven member 31, by means of the spring member 41.

Although the link member 33 is associated with the initiation of the operation of the maintenance unit 8 in the above-described embodiment, the initiation of the operation of the maintenance unit 8 can be controlled in a programmed manner in synchronism with the movement of the carriage 4 by providing the maintenance unit 8 with a specially designed power source (e.g., a motor). In this case, it is possible to actuate only the wiping unit 7 independently of the maintenance unit 8.

What is claimed is:

1. An ink jet printer, comprising:

a print head for ejecting ink droplets from nozzles;

a carriage;

carriage actuation means for linearly moving the carriage having the print head mounted thereon;

a wiper member which is movable between a projected position projected into a travel path of the print head and a standby position withdrawn from the travel path of the print head, which wipes a nozzle surface of the print head when it is situated at the projected position;

a first driven member and a second driven member disposed in association with the travel path of the carriage, and which selectively project into the travel path of the carriage; and a control means which performs a control operation in such a way that the wiper member moves to the projected position as a result of the carriage coming into contact with the first driven member, that the wiper member wipes the nozzle surface of the print head as a result of the carriage traveling toward the second driven member, and that the wiper member moves to the standby position as a result of the carriage coming into contact with the second driven member, wherein the control means has a spring member for maintaining the first and second driven members in their states obtained after the carriage has come into contact with a respective one of the first driven member and the second driven member.

2. The ink jet printer as claimed in claim 1, wherein the control means comprises a link member connecting the first driven member and the second driven member with each other and moving the wiper member between the projected position and the standby position.

3. The ink jet printer as claimed in claim 2, further comprising:

an absorption member for sucking ink from within the print head; and maintenance means joined to the control means for causing the absorption member to start an absorbing operation when the carriage comes into contact with the first driven member.

4. The ink jet printer as claimed in claim 3, further comprising a drive train, wherein the maintenance means has a cam member which rotates so as to cause the absorption member to perform an absorbing operation and the link member has a proterbance such that when the carriage comes into contact with the first driven member, the proterbance causes the drive train to be connected to the cam member to cause the cam member to rotate and when the carriage comes into contact with the second driven member, the cam member is disconnected from the gear train.

5. The ink jet printer as claimed in claim 1, wherein the first driven member is provided with a first contact portion and a first joint and the second driven member is provided with a second contact portion and a second joint.

6. The ink jet printer as claimed in claim 5, wherein the second driven member is set in such a way that the angle between the second contact portion and the second joint is smaller than the angle defined between the first contact portion and the first joint, and the second driven member is disposed further away from the travel path of the carriage than the first driven member is disposed away from the same.

7. The ink jet printer as claimed in claim 2, wherein the link member has a first end connected to the first driven member and a second end connected to the second driven member, the second end is disposed further apart from the travel path of the carriage than the first end is disposed apart from the same.

8. The ink jet printer as claimed in claim 2, wherein when the carriage comes into contact with the first driven member, the link member moves toward the carriage so that the wiper member advances to project into the travel path of the print head, and when the carriage comes into contact with the second driven member, the link member is actuated to move away from the carriage so that the wiper member recedes to the standby position away from the travel path of the print head.

9. A print head cleaning apparatus for an ink jet printer having a carriage carrying the print head and reciprocating along a print path, comprising:

a first driven member pivotally mounted to the ink jet printer;

a second driven member pivotally mounted to the ink jet printer and spaced apart from the first driven member;

a link member pivotally attached at a first end to the first driven member and at a second end to the second driven member;

a wiper blade movable from a first position clear of the print head moving along the print path to a second position inserted into the print path for scrape cleaning the print head; and a lever mechanism between the link member and the wiper blade controlling whether the wiper blade is in the first position or the second position, wherein the second driven member is more remote from the print path than the first driven member.

10. The print head cleaning apparatus as claimed in claims 9, wherein the first driven member and the second driven member each comprise a joint and a contact portion, an angle formed between the joint and the contact portion of the first driven member being larger than the angle formed between the joint and the contact portion of the second driven member.

11. The print head cleaning apparatus as claimed in claim 10, wherein during printing the contact portion of the first driven member extends into an extension of the print path for contacting the carriage when cleaning occurs.

12. The print head cleaning apparatus as claimed in claim 10, wherein during printing the contact portion of the second driven member is withdrawn from the print path.

13. The print head cleaning apparatus as claimed in claim 10, further comprising:

a pair of stoppers to limit a rotation range of the first driven member; and a spring for maintaining the first driven member in position against a respective one of the stoppers.

14. The print head cleaning apparatus as claimed in claim 9, wherein the lever mechanism comprises:

a wiper lever pivotally mounted to the ink jet printer and in contact with the linking member; and resilience means for urging the wiper lever against the linking member.

15. The print head cleaning apparatus as claimed in claim 14, wherein the wiper lever is pivotally mounted at one end to the ink jet printer and the wiper blade is pivotally mounted to an opposite end of the wiper lever, longitudinal axes of the linking member and the wiper lever being at substantially right angles to one another.

16. The print head cleaning apparatus as claimed in claim 9, further comprising:

a drive source;

a cleaning mechanism driven by the drive source; and a gear train linking the drive source and the cleaning mechanism, comprising:

a slide gear continuously engaged with the drive source;

an idle gear continuously engaged with the cleaning mechanism; and means for engaging and disengaging the slide gear with the idle gear.

17. The print head cleaning apparatus as claimed in claim 16, wherein the linking member further comprises a protuberance contacting the slide gear to cause the slide gear to engage the idle gear.

18. The print head cleaning apparatus as claimed in claim 17, wherein the means for disengaging the slide gear is a coil spring.

* * * * *